US010443950B2

(12) United States Patent
Derevyagin

(10) Patent No.: US 10,443,950 B2
(45) Date of Patent: Oct. 15, 2019

(54) METHOD AND DEVICE FOR HEAT TRANSFER

(71) Applicant: Alexandr Mikhailovich Derevyagin, Moscow (RU)

(72) Inventor: Alexandr Mikhailovich Derevyagin, Moscow (RU)

( * ) Notice: Subject to any disclaimer, the term of this patent is extended or adjusted under 35 U.S.C. 154(b) by 280 days.

(21) Appl. No.: 15/120,986

(22) PCT Filed: Feb. 20, 2015

(86) PCT No.: PCT/RU2015/000109
§ 371 (c)(1),
(2) Date: Aug. 23, 2016

(87) PCT Pub. No.: WO2015/130197
PCT Pub. Date: Mar. 9, 2015

(65) Prior Publication Data

US 2016/0363382 A1 Dec. 15, 2016

(30) Foreign Application Priority Data

Feb. 25, 2014 (RU) ..... 2014106980

(51) Int. Cl.
*F28D 15/02* (2006.01)
*F28F 13/06* (2006.01)

(52) U.S. Cl.
CPC ..... *F28D 15/0266* (2013.01); *F28D 15/025* (2013.01); *F28F 13/06* (2013.01); *F28F 2250/08* (2013.01)

(58) Field of Classification Search
CPC .... F28D 15/0266; F28D 15/025; F28D 15/02; F28F 13/06; F28F 2250/08
(Continued)

(56) References Cited

U.S. PATENT DOCUMENTS 3,958,627 A * 5/1976 Edelstein ..... F28D 15/06 165/104.26
4,467,862 A * 8/1984 DeBeni ..... F28D 15/0266 165/104.22
(Continued)

FOREIGN PATENT DOCUMENTS

GB 2103782 2/1983
JP S6189494 5/1986

OTHER PUBLICATIONS

International Search Report and Written Opinion, issued by the European Patent Office dated Jul. 23, 2015, for International Application No. PCT/RU2015/000109; 9 pages.

*Primary Examiner* — Joseph F Trpisovsky
(74) *Attorney, Agent, or Firm* — Faegre Baker Daniels LLP

(57) ABSTRACT

A method for transferring heat includes: heating an evaporator by a thermal energy source; providing a flow of a mixture of gaseous phases of a first and a second fluid over a steam line into a condenser; providing a flow of the condensed mixture over a liquid line into an accumulation tank; and providing a flow of the condensed mixture from the accumulation tank to the evaporator tank through non-return valves mounted on a return line. The method ensures transferring of a large quantity of thermal energy from a source to a receiver over considerable distances without application of porous capillary materials and additional processes for forced pumping of condensed fluid, regardless of the position of the source and the receiver in the gravity field.

21 Claims, 7 Drawing Sheets

(58) Field of Classification Search
USPC ..... 62/119
See application file for complete search history.

(56) References Cited

U.S. PATENT DOCUMENTS 4,494,595 A 1/1985 Schmid
4,745,906 A * 5/1988 DeBeni ..... F28D 15/0266
126/584

* cited by examiner

METHOD AND DEVICE FOR HEAT TRANSFER

CROSS-REFERENCE TO RELATED APPLICATIONS

This application is a U.S. national phase application under 35 U.S.C. § 371 of International Application No. PCT/RU2015/000109, filed Feb. 20, 2015, which claims priority to Russian Patent Application No. 2014106980, filed Feb. 25, 2014, the disclosures of which are expressly incorporated herein by reference in their entirety.

FIELD OF THE INVENTION

The invention relates to thermal technology and can be used to transfer large quantities of heat with small temperature differences (gradient) over considerable distances, in particular, to transfer considerable heat flows from one device to another, for example, to transfer heat power of up to 10 kW or more over a distance of from 0.01 m to 1 km or more.

DESCRIPTION OF THE PRIOR ART

There is a need in technology to transfer significant heat flows amounting to units or tens of kilowatts from a heat source to a heat consumer spaced by a considerable distance approximately of tens of meters and up to 1 km. Moreover, in conditions of high sparking and fire hazard environment a heat source, which burns fuel to produce heat, and a heat consumer situated in the high sparking and fire hazard environment should be spaced apart to maximum extent. There are heat transfer methods based on application of heat pipes. However, conventional technical solutions use, as a mechanism to return condensed refrigerant, a wick of porous material or means employing the gravity force or additional means for forced pumping, which provide transport of condensed refrigerant from condensation area to evaporation area. Moreover, conventional solutions are not capable of transferring substantial quantities of heat over large distances from 40 m to 1 km or more.

There are conventional solutions that use a wick of porous material. The wick material must provide a uniform flow of liquid through capillary pores. The wick can comprise metal felts, metal stacks or twill weave fabrics. Best materials for a heat pipe wick are titanium, copper, nickel, and stainless steel. Such a mechanism is disclosed, for example, in RU 2208209.

Other solutions use a gravitational mechanism to return condensed refrigerant, in which a condenser is disposed higher than an evaporator, and the refrigerant is returned to the evaporation area by overflow of the condensed refrigerant from the condenser disposed higher than the level of the evaporator relative to the gravity field. The mechanism is disclosed, in particular, in RU 2349852.

In another solution taught in RU 2361168, which is considered as the most relevant prior art, the condensed refrigerant is returned using additional means for forced pumping of the condensed refrigerant. RU 2361168 discloses a heat pipe comprising one or more heat sink sections in contact with heat energy source/sources, one or more steam lines, one or more heat-release sections in contact with thermal energy receiver/receivers, and one or more liquid lines forming a closed system containing a working fluid in the form of a liquid and its vapor, the liquid line having an accumulation/displacement section bounded by a device adapted to permit flow of the working fluid in the direction from the heat-release section to the accumulation/displacement section and to prevent flow of the working fluid in the reverse direction, characterized in that the accumulation/displacement section is also bounded by a device adapted to permit flow of the working fluid in the direction from the accumulation/displacement section to the heat sink section and to prevent flow of the working fluid in the reverse direction; and the accumulation/displacement section has a branch comprising an evaporation section communicating with the accumulation/displacement section and contacting with the thermal energy source; a condensation section arranged downstream of the evaporator section and contacting with the thermal energy receiver; the accumulation/displacement section arranged downstream of the condensation section and comprising either a device for periodically heating the section to a temperature higher than the temperature of liquid line sections of the heat pipe and for periodically cooling the section to a temperature not higher than the temperature of liquid line sections of the heat pipe, or has a branch of a next level.

In the most relevant prior art, RU 2361168, the forced pumping means for condensed refrigerant comprise accumulation/displacement tanks equipped with thermoelectric modules, such as Peltier elements. Alternate cooling and heating of accumulation/displacement tanks with the aid of Peltier elements alternately changes the pressure, which reverses the flow of the condensed refrigerant from the condenser to the evaporator.

Application of the aforementioned mechanisms for returning condensed refrigerant has a number of disadvantages and limitations in practice. In particular, systems that use a wick suffer from low productivity and are incapable of transferring considerable quantities of heat over large distances. Systems with a return mechanism using the gravity force impose severe restriction on positioning the condenser, which must be disposed higher than the evaporator, since at a different arrangement the systems simply will not work. Systems that use a forced return mechanism require additional power supply and additional means for pumping the condensed refrigerant, which complicate the design and increase considerably the cost of the final device.

Accordingly, there is a need to provide a heat pipe for transferring large quantity of heat from an evaporator to a condenser spaced by a considerable distance from the evaporator, which wouldn't be using a wick or additional forced pumping means for condensed refrigerant, and in which both the evaporator and the condenser would be positioned at about the same level in the gravity field.

SUMMARY OF THE INVENTION

To overcome the aforementioned disadvantages there is provided a method for transferring heat, comprising:

heating by a thermal energy source one or more evaporator tanks (1) filled with at least two different fluids, where a first fluid is in a gaseous phase and a second fluid is in a liquid phase;

causing by said heating an increase in pressure in the evaporator tank and a transition of the liquid phase of the second fluid into a gaseous phase of the second fluid, which is mixed with the gaseous phase of the first fluid;

under the increased pressure in the evaporator tank, providing a flow of the mixture of the gaseous phases of the first and second fluid over one or more steam lines (2) into one or more condensers (3), where the gaseous phase of the second fluid is condensed with release of condensation heat to a thermal energy receiver and formation of a liquid phase of the second fluid;

under the increased pressure in the evaporator tank, providing a flow of the condensed liquid phase of the second fluid mixed with the gaseous phase of the first fluid over a liquid line (4) into an accumulation tank (5) until pressure in the evaporator tank (1) exceeds that in the accumulation tank (5);

once the entire second fluid has transited from the liquid phase to the gaseous phase in the evaporator tank, while condensation of the gaseous phase of the second fluid in the condenser is continuing, reducing pressure in the evaporator tank to a pressure value lower than that in the accumulation tank, thereby ensuring a flow of the condensed liquid phase of the second fluid and the gaseous phase of the first fluid from the accumulation tank to the evaporator tank through one or more non-return valves mounted on a return line.

Also, a device is provided to implement the inventive method for transferring heat, said device comprising:

one or more evaporator tanks (1) filled with at least two different fluids, where a first fluid is in a gaseous phase and a second fluid is in a liquid phase;

one or more condensers (3) adapted to condense the gaseous phase of the second fluid with release of condensation heat to a thermal energy receiver;

one or more accumulation tanks (5) adapted to accumulate the condensed liquid phase of the second fluid and the gaseous phase of the first fluid; one or more steam lines (2) connecting one or more evaporator tanks and one or more condensers (3), and providing a flow over the steam line (2) of a mixture of the gaseous phases of the first and second fluid into the condenser (3) under increased pressure caused by heating the evaporator tank (1) until pressure in the evaporator tank (1) exceeds that in the accumulation tank (5);

one or more liquid lines (4) connected with one or more condensers (3) and providing a flow of the condensed liquid phase of the second fluid mixed with the gaseous phase of the first fluid into the accumulation tank (5) until pressure in the evaporator tank (1) exceeds that in the accumulation tank (5);

one or more return lines having one or more non-return valves mounted thereon to prevent the flow of the fluids from the evaporator tank into the accumulation tank over the return line, wherein the return line provides a flow of the condensed liquid phase of the second fluid and the gaseous phase of the first fluid from the accumulation tank into the evaporator tank once the entire second fluid in the liquid phase in the evaporator tank has transited into a gaseous phase, while condensation of the gaseous phase of the second fluid in the condenser is continuing, and pressure in the evaporator tank is less than that in the accumulation tank.

The invention ensures the transfer of a large quantity of thermal energy from a source to a receiver over considerable distances without application of porous capillary materials and additional means for forced pumping of condensed fluid and regardless of the position of the source and the receiver in the gravity field. In addition, the invention makes it possible to space apart a heat source, which employs consumption of fuel, and a heat consumer situated in a high fire hazard environment.

EMBODIMENTS OF THE INVENTION

Figure 1:
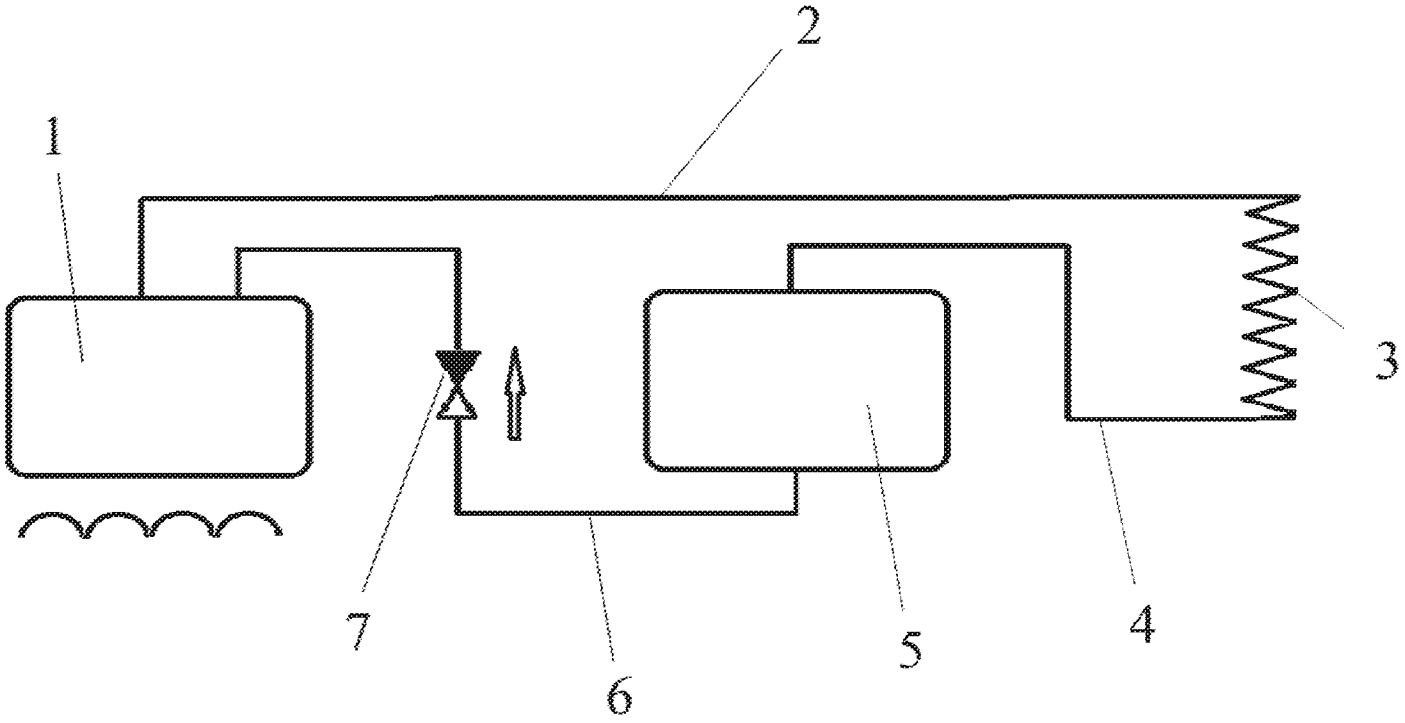
FIG. 1 shows an embodiment of a heat transfer device, in which an evaporator tank is connected directly to a condenser via a steam line.

The invention provides a method for transferring heat and a device for implementing the method. Referring to FIG. 1, a heat transfer device comprises an evaporator tank (1) filled with at least two different fluids, where a first fluid is in a gaseous phase and a second fluid is in a liquid phase. The evaporator tank can be a reservoir in the shape of a a polyhedron, an axisymmetric body, or combinations thereof, as well as in the shape of a coil or a group of coils. Multiple evaporator tanks can be also used, for example, a plurality of tanks connected by respective channels for transport of fluids. In a particular embodiment the evaporator tank has the volume of five liters.

The evaporator tank is filled with two fluids having different compositions and being in two different phase states, one of the fluids in the evaporator tank being in a gaseous phase, and the other in a liquid phase. The first fluid in a gaseous phase can be a fluid selected from the group consisting of air, nitrogen, helium, hydrogen, carbon dioxide or any other gases used in industry, or combinations thereof. The second fluid in a liquid phase is a refrigerant selected from the group consisting of ammonia, freons (chlorofluorohydrocarbons), hydrocarbons, alcohols, acetone, water, or mixtures thereof, and other boiling up liquids.

After filling the evaporator tank with at least two different fluids, heat is supplied to the evaporator tank by burning a fuel, heating by electrical sources, using heat of flue gas from turbine generators, rejected heat of thermal power plants and process plants, solar and geothermal heat sources, or combinations thereof. The heating may be also provided by any other conventional method.

During heating the evaporator tank (1) the second fluid in a liquid phase evaporates, and turns to a gaseous phase of the second fluid, and the gaseous phase of the second fluid mixes with the gaseous phase of the first fluid. At evaporation of the liquid phase of the second fluid and increase of pressure in the evaporator tank the mixture of gaseous phases of the first and second fluid will flow into the condenser (3) over the steam line (2) until pressure in the evaporator tank (1) exceeds pressure in the accumulation tank (5). The steam line (2) connects the evaporator tank (1) with the condenser (3) and provides the flow of the mixture of gaseous phases of the first and second fluid therein. The steam line has a length of from 0.01 m to over 1 km. Pressure in the evaporator at transition of the liquid phase of the second fluid into a gaseous phase is greater than pressure in the accumulation tank by 5 to 10 atmospheres or more.

Steam line can be implemented by several lines interconnected by channels for passage of fluid. Mixture of gaseous phases of the first and second fluid enters the condenser where it is cooled to the saturation temperature and gives heat to a thermal energy receiver; after condensation the gaseous phase of the second fluid turns to a condensed liquid phase of the second fluid. The condenser may be a contact condenser, or a surface condenser, or a combination thereof. In particular, the condenser may be a tube bundle consisting of several coils. Upper tubes of the coils are connected to the steam line, and lower tubes are connected to the liquid line.

To prevent a reverse flow of the condensed liquid phase of the second fluid and the gaseous phase of the first fluid in the steam line, the total hydraulic resistance of the steam line, the condenser and the liquid line is greater than the hydraulic resistance of the return line.

The condensed liquid phase of the second fluid leaves the condenser under the effect of high pressure in the evaporator tank and enters the liquid line (4) connecting the condenser (3) with accumulation tank (5), which accumulates the condensed liquid phase of the second fluid and the gaseous phase of the first fluid.

Cross-sectional area of each of the steam line, the condenser, and the liquid line is from 0.00001 sq m to 10 sq m. Length of each of the steam line, the condenser, and the liquid line is from 0.01 m to 10 km. In an embodiment the steam line, the condenser and the liquid line form an integral pipeline having uniform cross section, or a plurality of pipelines having different cross sections, where the pipelines are connected in series or in parallel. In an embodiment the integral pipeline is a coaxial tubular structure divided by at least one heat insulating layer. In this case the gaseous phase of the first fluid and the gaseous phase of the second fluid are supplied through the outer annular space, while the condensed liquid phase of the second fluid and the gaseous phase of the first fluid are returned through the inner annular space, or vice versa, the supply is provided through the inner annular space, and the return through the outer annular space. In a particular case the integral pipeline has the length of 70 m and the cross-sectional area of 0.00002 sq m. The second fluid in a liquid phase is pentane, and the first fluid in a gaseous phase is helium. The volumetric ratio between the first fluid in a gaseous phase and the second fluid in a liquid phase is 80:20.

The transport of the condensed liquid phase of the second fluid mixed with the gaseous phase of the first fluid into the accumulation tank (5) will proceed until pressure in the evaporator tank (1) exceeds pressure in the accumulation tank (5). The accumulation tank can be a reservoir in the shape of a polyhedron, an axisymmetric body, or a combination thereof. The accumulation tank can be also formed of multiple tanks connected by respective channels for transport of fluids. Liquid line is connected to the accumulation tank through an inlet in the accumulation tank, disposed in the upper part of the accumulation tank.

Outlet of the accumulation tank is disposed in the lower part of the accumulation tank and connected with a return pipe (6) which has at least one non-return valve (7) to prevent the flow of fluids from the evaporator tank (1) to the accumulation tank (5) over the return pipe until pressure in the evaporator tank becomes lower than pressure in the accumulation tank.

Once the liquid phase of the second fluid in the evaporator tank has fully transited to a gaseous phase, while condensation of the gaseous phase of the second fluid in the condenser is continuing, pressure in the evaporator tank (1) becomes lower than that in the accumulation tank (5), the non-return valve (7) opens and the condensed liquid phase of the second fluid and the gaseous phase of the first fluid move from the accumulation tank (5) to the evaporator tank through the return line (6), and then the cycle repeats.

Figure 2:
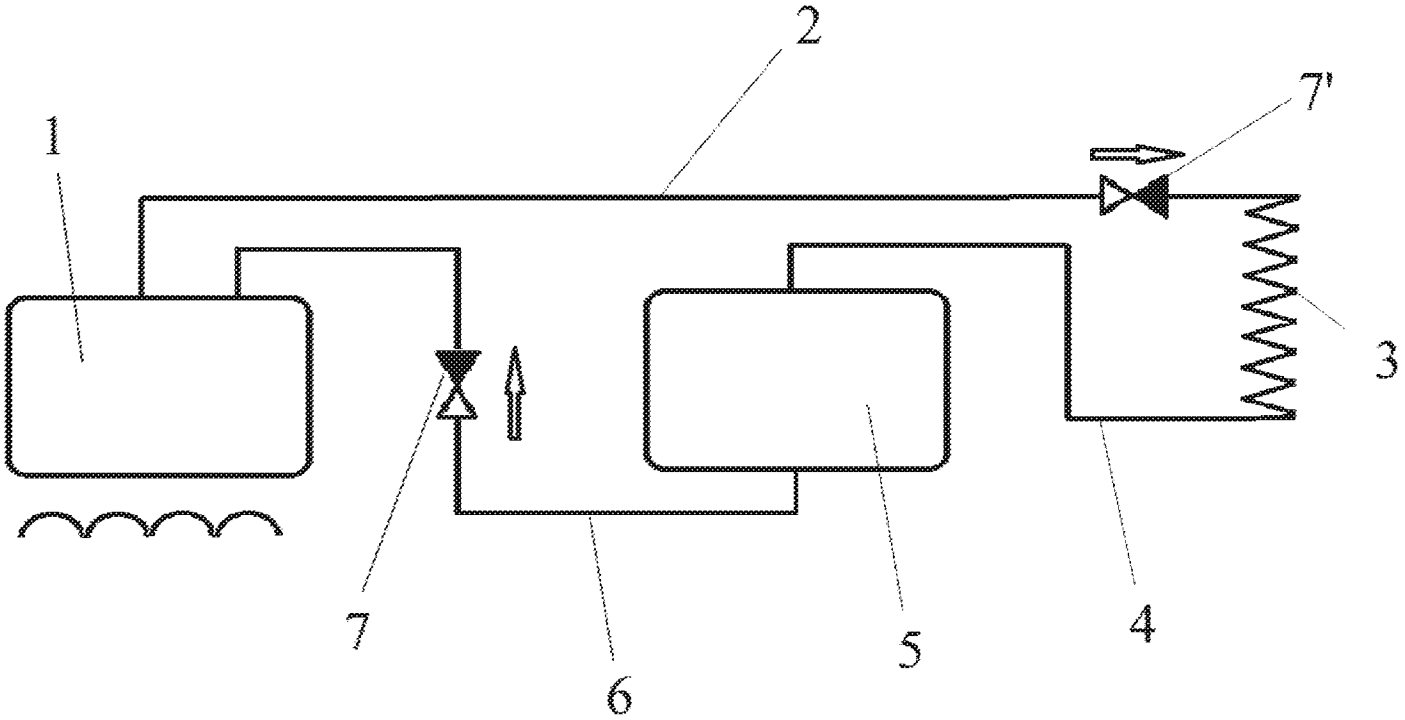
FIG. 2 shows an embodiment of a heat transfer device, which further comprises a non-return valve on a steam line.

In an embodiment shown in FIG. 2 a non-return valve (7') is further mounted on the steam line (2) to prevent a reverse flow of the condensed liquid phase of the second fluid and the gaseous phase of the first fluid over the steam line. Such implementation is necessary if the total hydraulic resistance of the steam line, the condenser and the liquid line is less than the hydraulic resistance of the return line.

Figure 3:
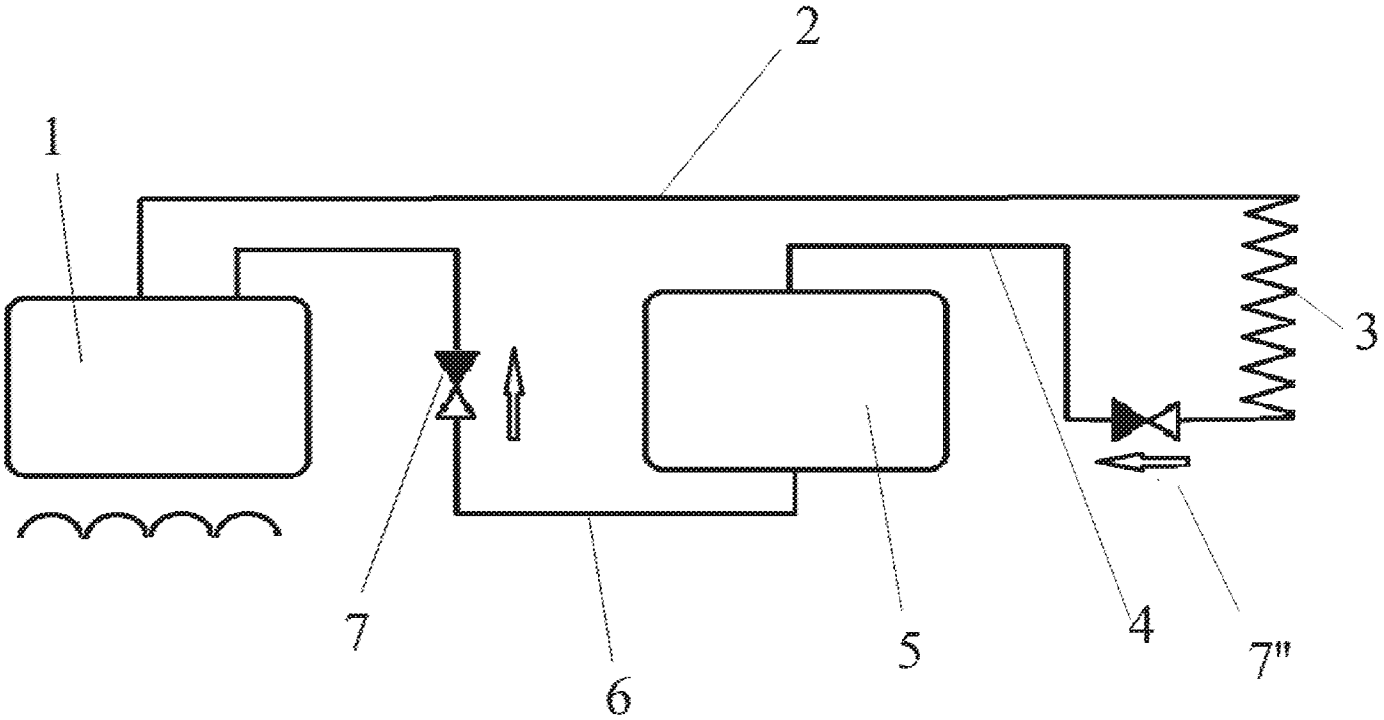
FIG. 3 shows an embodiment of a heat transfer device, which further comprises a non-return valve mounted on a liquid line.

In an embodiment shown in FIG. 3 a non-return valve (7") is further mounted on the liquid line (4) to prevent a flow of the condensed liquid phase of the second fluid and the gaseous phase of the first fluid over the steam line.

Figure 4:
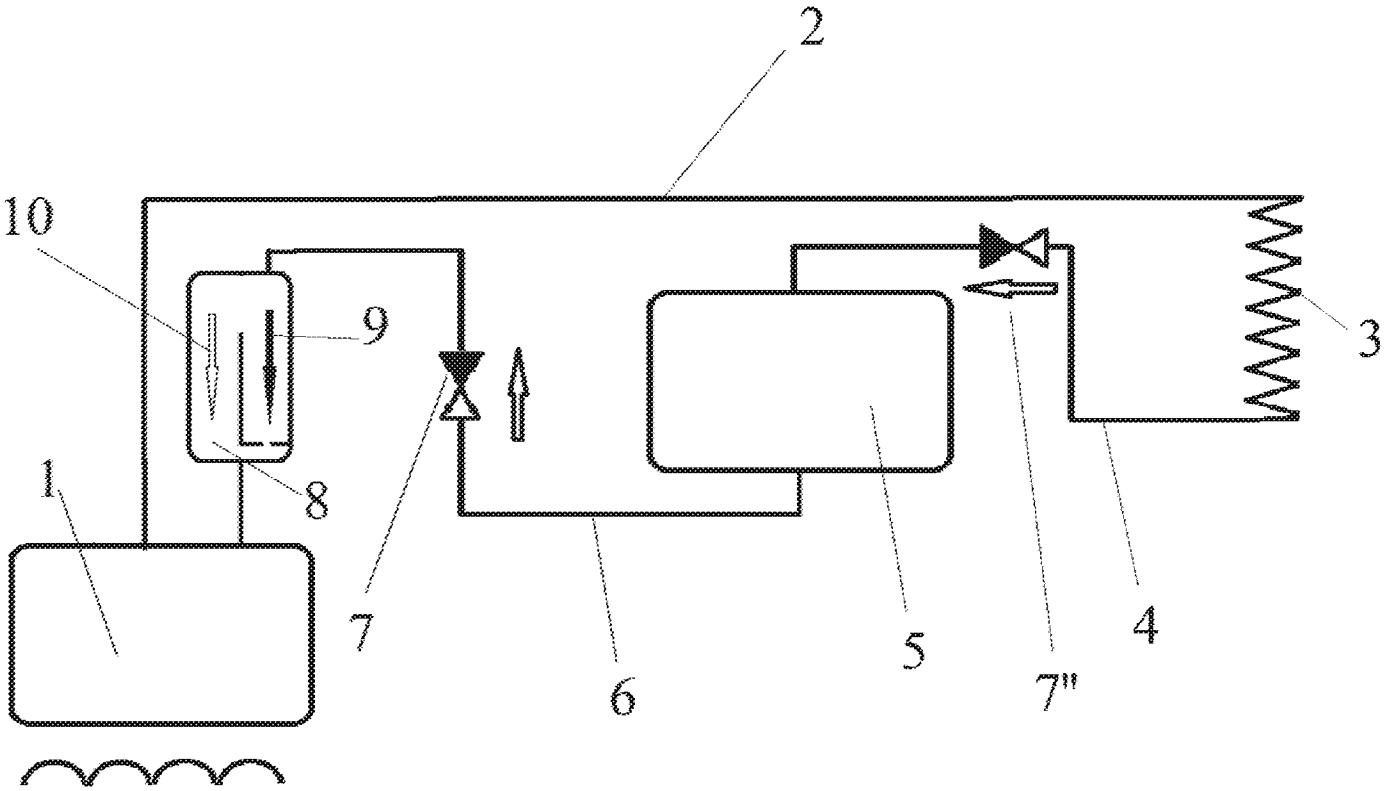
FIG. 4 shows an embodiment of a heat transfer device, in which a return line further comprises a separator to separate the mixture of the gaseous phase of first fluid and the condensed liquid phase of the second fluid, leaving the accumulation tank, into a flow of the gaseous phase of the first fluid and a flow of the liquid phase of the second fluid, and to provide a delay between the arrival time of the gaseous phase of the first fluid and the arrival time of the liquid phase of the second fluid in the evaporator tank.

In an embodiment shown in FIG. 4 a separator (8) is further mounted on the return line higher than the level of the evaporator tank to separate the mixture of the gaseous phase of the first fluid and the condensed liquid phase of the second fluid, leaving the accumulation tank, into a flow (10) of the gaseous phase of the first fluid and a flow (9) of the liquid phase of the second fluid, and thereby provide a delay between the arrival time of the gaseous phase of the first fluid and the arrival time of the liquid phase of the second fluid in the evaporator tank via the separator outlet. The separator is provided due to the fact that once pressure in the evaporator has become less than that in the accumulation tank, the mixture of the gaseous phase of the first fluid and the condensed liquid phase of the second fluid rushes in a great amount via the non-return valve into the evaporator, thereby increasing pressure in the evaporator tank and closing the non-return valve and stopping the flow of fluids to the evaporator, which impairs the performance of the heat transfer device. To prevent stopping the flow the mixture is separated in the separator into a flow (9) of the liquid phase of the second fluid and a flow (10) of the gaseous phase of the first fluid; so the flow (10) of the gaseous phase of the first fluid arrives in the evaporator first, and then the flow (9) of the liquid phase of the second fluid starts entering the evaporator tank. The separation of the arrival time of the gaseous and liquid medium prevents stopping the flow.

Figure 5:
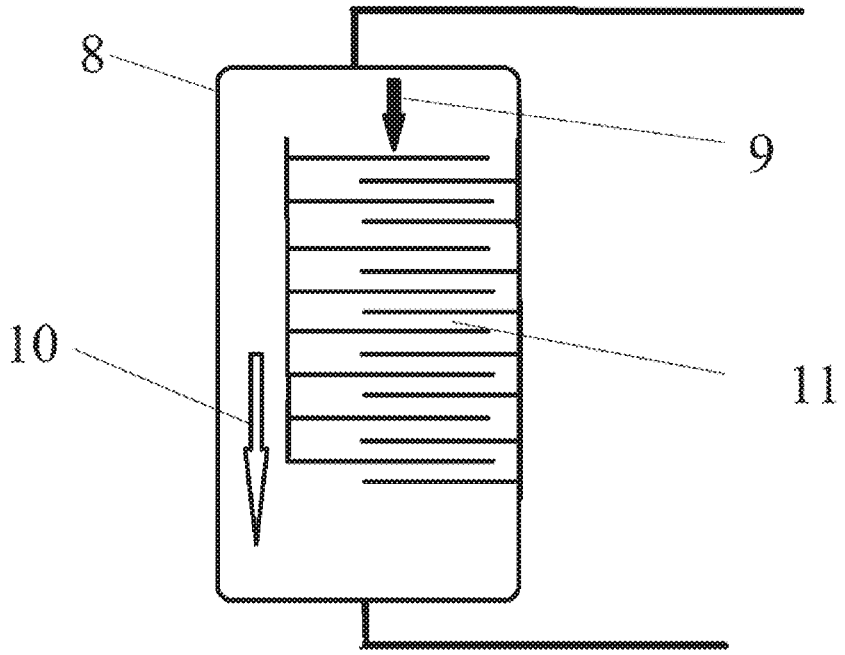
FIG. 5 shows an embodiment of a separator comprising a set of partitions.
Figure 6:
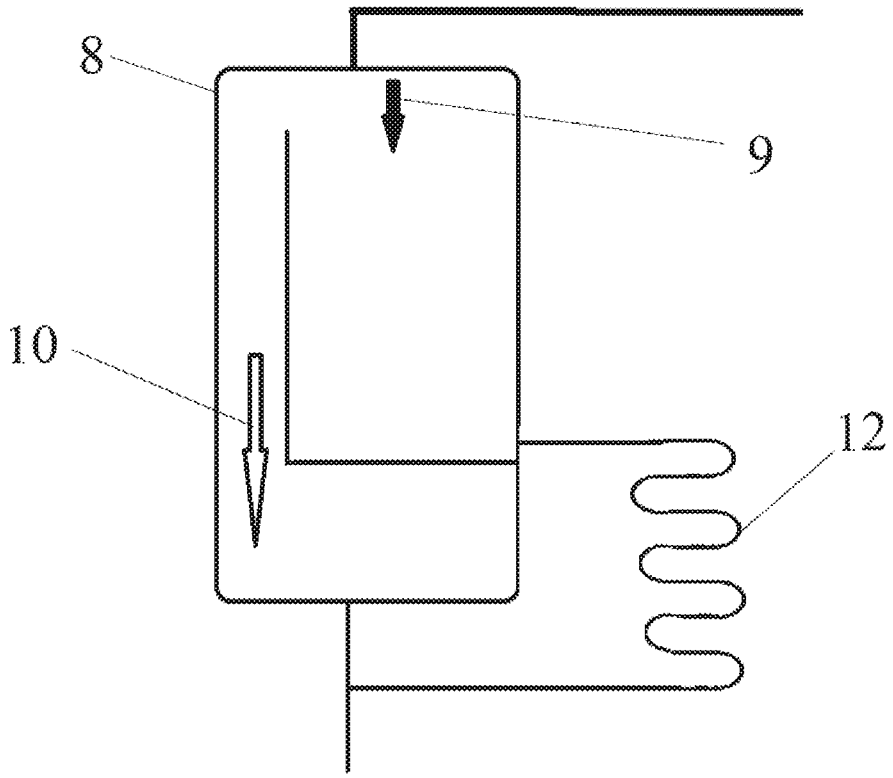
FIG. 6 shows an embodiment of a separator comprising a coil.
Figure 7:
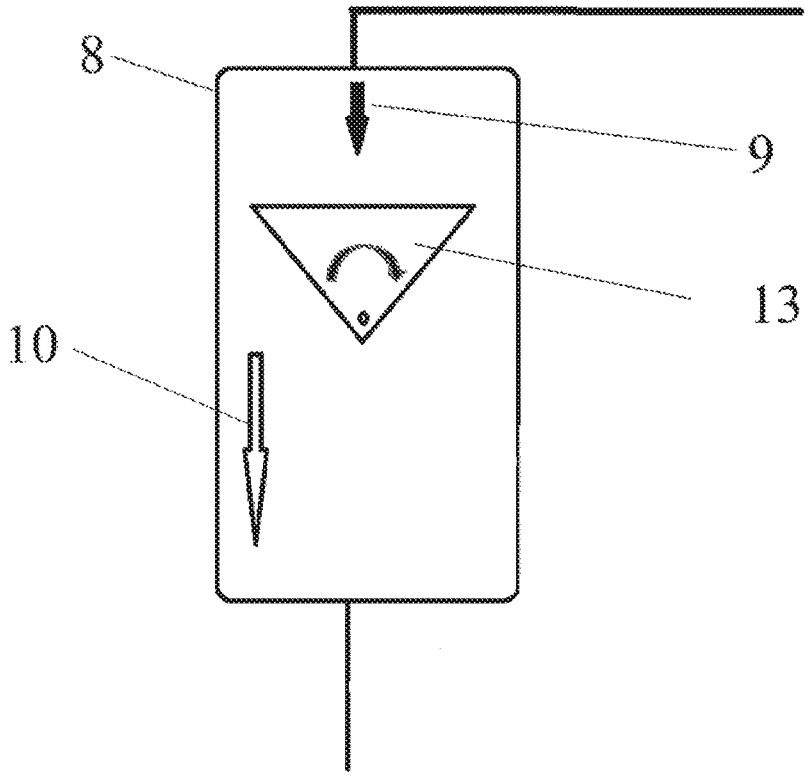
FIG. 7 shows an embodiment of a separator comprising a reservoir with displaceable center of gravity.

FIGS. 5-7 show embodiments of a separator (8). A separator (8) in FIG. 5 is a reservoir divided into at least two parts, wherein when the non-return valve on the return line is open the mixture of the gaseous phase of the first fluid and the liquid phase of the second fluid enters the separator via the separator inlet, and the flow (10) of the gaseous phase of the first fluid immediately flows into the first part of the separator and then, through the separator outlet, into the evaporator tank, while the flow (9) of the liquid phase of the second fluid enters a delay system (11) comprising partitions mounted horizontally in alternating order, the partitions having overlapped edges between which slotted passages are formed, in which the liquid phase of the second fluid flows under the gravity force; as a result, the flow (10) of the gaseous phase of the first fluid arrives first at the separator outlet, and the flow (9) of the liquid phase of the second fluid arrives at the separator outlet with a delay caused by the time for passage of the flow (9) of the liquid phase of the second fluid through the delay system (11) formed by slots and partitions.

In another embodiment shown in FIG. 6, a separator (8) is a vessel divided into two parts, wherein when the non-return valve on the return line is open the mixture of the gaseous phase of the first fluid and the liquid phase of the second fluid enters the separator through an inlet of the separator. The flow (10) of the gaseous phase of the first fluid enters initially through an inlet of the separator into the first part of the separator, and then is immediately directed through an outlet of the separator into the evaporator tank, while the flow (9) of the liquid phase of the second fluid enters a coil-shaped delay system (12), the time of passage through which will also provide the required delay between the arrival of the gaseous phase of the first fluid and the arrival of the liquid phase of the second fluid at the separator outlet.

In another embodiment shown in FIG. 7 a reservoir with displaceable center of gravity is mounted in a separator vessel, and when the non-return valve on the return line is open the mixture of the gaseous phase of the first fluid and the liquid phase of the second fluid enters the separator through an inlet of the separator, and the flow (10) of the gaseous phase of the first fluid initially enters the first part of the separator, and then is immediately directed through an outlet of the separator into the evaporator tank, while the flow (9) of the liquid phase of the second fluid enters a delay system (13) formed by the reservoir with displaceable center of gravity, accommodated in the separator. The separator inlet is disposed immediately over the reservoir with displaceable center of gravity, and the volume of this reservoir is equal to the entire volume of the liquid phase of the second fluid. Once the reservoir has been filled with the liquid phase of the second fluid, its centre of gravity displaces, and the reservoir tilts, thereby providing the necessary delay between the arrival time of the gaseous phase of the first fluid and the arrival time of the liquid phase of the second fluid in the evaporator tank. After tilting, the reservoir returns to its original position, and the cycle repeats.

The invention enables the transfer of large quantities of heat over considerable distances. In particular, the invention can find application in extraction of hydrocarbons under Far North conditions, where it is necessary to ensure combustion of available hydrocarbons at a considerable distance from a heat consumer situated in high sparking and fire hazard environment, for example, on a rig floor.

The invention claimed is:

1. A method for transferring heat, comprising:

heating by a thermal energy source at least one evaporator tank filled with at least two different fluids, where a first fluid is in a gaseous phase and a second fluid is in a liquid phase;

causing by said heating an increase in pressure in the at least one evaporator tank and a transition of the liquid phase of the second fluid into a gaseous phase of the second fluid, which is mixed with the gaseous phase of the first fluid;

under the increased pressure in the at least one evaporator tank, providing a flow of the mixture of the gaseous phases of the first and the second fluid over at least one steam line into at least one condenser, where the gaseous phase of the second fluid is condensed with release of condensation heat to a thermal energy receiver and formation of a liquid phase of the second fluid;

under the increased pressure in the at least one evaporator tank, providing a flow of the condensed liquid phase of the second fluid mixed with the gaseous phase of the first fluid over at least one liquid line into at least one accumulation tank until pressure in the at least one evaporator tank exceeds pressure in the at least one accumulation tank;

once the entire second fluid has transited from the liquid phase to the gaseous phase in the at least one evaporator tank, while condensation of the gaseous phase of the second fluid in the at least one condenser is continuing, reducing pressure in the at least one evaporator tank to a pressure value lower than that in the at least one accumulation tank, thereby ensuring a flow of the condensed liquid phase of the second fluid and the gaseous phase of the first fluid from the at least one accumulation tank to the at least one evaporator tank through at least one non-return valve mounted on at least one return line, wherein a separator is further provided on the at least one return line to separate the mixture of the gaseous phase of the first fluid medium and the condensed liquid phase of the second fluid leaving the at least one accumulation tank into a flow of the gaseous phase of the first fluid and a flow of the liquid phase of the second fluid and to provide a delay between the arrival time of the gaseous phase of the first fluid and the arrival time of the liquid phase of the second fluid in the at least one evaporator tank, wherein the gaseous phase of the first fluid arrives first, and then the liquid phase of the second fluid arrives.

2. A method according to claim 1, wherein the first fluid is selected from the group consisting of air, nitrogen, helium, hydrogen, carbon dioxide.

3. A method according to claim 1, wherein the second fluid is a refrigerant, alcohols, acetone, water, or mixtures thereof.

4. A method according to claim 1, wherein the at least one steam line has a length from 0.01 m to over 1 km.

5. A method according to claim 1, wherein pressure in the at least one evaporator tank at transition of the liquid phase of the second fluid into a gaseous phase exceeds pressure in the at least one accumulation tank by 5 to 10 atmospheres.

6. A method according to claim 1, wherein the total hydraulic resistance of the at least one steam line, at least one condenser and at least one liquid line is greater than the hydraulic resistance of the at least one return line.

7. A method according to claim 1, wherein at least one non-return valve is mounted on the at least one steam line to prevent a reverse flow of the condensed liquid phase of the second fluid mixed with the gaseous phase of the first fluid from the at least one accumulation tank to the at least one evaporator tank.

8. A method according to claim 7, wherein the at least one non-return valve is mounted on the at least one liquid line to prevent a reverse flow of the condensed liquid phase of the second fluid mixed with the gaseous phase of the first fluid from the at least one accumulation tank to the at least one or more condenser.

9. A method according to claim 1, wherein the at least one steam line, the at least one condenser and the at least one liquid line form an integral pipeline.

10. A device for transferring heat, comprising:

at least one evaporator tank filled with at least two different fluids, where a first fluid is in a gaseous phase and a second fluid is in a liquid phase;

at least one condenser adapted to condense the gaseous phase of the second fluid with release of condensation heat to a thermal energy receiver;

at least one accumulation tank adapted to accumulate the condensed liquid phase of the second fluid and the gaseous phase of the first fluid;

at least one steam line connecting the at least one evaporator tank and the at least one condenser, and providing a flow over the at least one steam line of a mixture of the gaseous phases of the first and second fluids into the at least one condenser under increased pressure caused by heating the at least one evaporator tank until pressure in the at least one evaporator tank exceeds that in the at least one accumulation tank;

at least one liquid line connected with the at least one condenser and providing a flow of the condensed liquid phase of the second fluid mixed with the gaseous phase of the first fluid into the at least one accumulation tank until pressure in the at least one evaporator tank exceeds that in the at least one accumulation tank;

at least one return line having at least one non-return valve mounted thereon to prevent the flow of the fluids from the at least one evaporator tank into the at least one accumulation tank over the at least one return line, wherein the at least one return line provides a flow of the condensed liquid phase of the second fluid and the gaseous phase of the first fluid from the at least one accumulation tank into the at least one evaporator tank once the entire second fluid in the liquid phase in the at least one evaporator tank has transited into a gaseous phase, while condensation of the gaseous phase of the second fluid in the at least one condenser is continuing, and pressure in the at least one evaporator tank is less than that in the at least one accumulation tank, wherein a separator is further provided on the at least one return line to separate the mixture of the gaseous phase of the first fluid and the condensed liquid phase of the second fluid leaving the at least one accumulation tank into a flow of the gaseous phase of the first fluid and a flow of the liquid phase of the second fluid and to provide a delay between the arrival time of the gaseous phase of the first fluid and the arrival time of the liquid phase of the second fluid in the at least one evaporator tank, wherein the gaseous phase of the first fluid arrives first, and then the liquid phase of the second fluid arrives.

11. A device according to claim 10, wherein the first fluid is selected from the group consisting of air, nitrogen, helium, hydrogen, carbon dioxide.

12. A device according to claim 10, wherein the second fluid is a refrigerant, alcohols, acetone, water, or mixtures thereof.

13. A device according to claim 10, wherein the at least one steam line has a length from 0.01 m to over 1 km.

14. A device according to claim 10, wherein pressure in the at least one evaporator tank at transition of the liquid phase of the second fluid into a gaseous phase is greater than pressure in the at least one accumulation tank by 5 to 10.

15. A device according to claim 10, wherein the total hydraulic resistance of the at least one steam line, the at least one condenser and the at least one liquid line is greater than the hydraulic resistance of the at least one return line.

16. A device according to claim 10, wherein at least one non-return valve is further mounted on the at least one steam line to prevent a reverse flow of the condensed liquid phase of the second fluid mixed with the gaseous phase of the first fluid from the at least one accumulation tank to the at least one evaporator tank over the at least one liquid line through the at least one condenser and the at least one steam line.

17. A device according to claim 16, wherein at least one non-return valve is further mounted on the at least one liquid line to prevent a reverse flow of the condensed liquid phase of the second fluid mixed with gaseous phase of the first fluid from the at least one accumulation tank to the at least one condenser.

18. A device according to claim 10, wherein the at least one accumulation tank is mounted above the at least one evaporator tank.

19. A device according to claim 10, wherein the at least one accumulation tank has an inlet for entrance of the mixture of the gaseous phase of the first fluid and the liquid phase of the second fluid, said inlet being disposed in the upper part of the at least one accumulation tank.

20. A device according to claim 10, wherein the at least one accumulation tank has an outlet in the lower part of the at least one accumulation tank for exit of the mixture of the condensed liquid phase of the second fluid and the gaseous phase of the first fluid from the at least one accumulation tank to the at least one evaporator tank.

21. A device according to claim 10, wherein the at least one steam line, the at least one condenser and the at least one liquid line form an integral pipeline.

* * * * *